US008472842B2

(12) United States Patent
Hashimoto et al.

(10) Patent No.: US 8,472,842 B2
(45) Date of Patent: Jun. 25, 2013

(54) IMAGE FORMING DEVICE INCLUDING PROCESS UNIT PROVIDED WITH HANDLE

(75) Inventors: Junichi Hashimoto, Toyohashi (JP); Yoji Tsujishita, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 351 days.

(21) Appl. No.: 12/975,465

(22) Filed: Dec. 22, 2010

(65) Prior Publication Data

US 2011/0211865 A1 Sep. 1, 2011

(30) Foreign Application Priority Data

Feb. 26, 2010 (JP) ..... 2010-042968

(51) Int. Cl.
*G03G 15/04* (2006.01)

(52) U.S. Cl.
USPC ..... 399/119; 399/107; 399/110; 399/111; 399/262

(58) Field of Classification Search
USPC ..... 399/107, 110, 111, 119, 223, 228, 399/262
See application file for complete search history.

(56) References Cited

U.S. PATENT DOCUMENTS

| | | | | |
|---|---|---|---|---|
| 6,608,981 | B2 | 8/2003 | Mae | |
| 7,555,245 | B2 * | 6/2009 | Kamimura | 399/228 |
| 7,636,531 | B2 | 12/2009 | Ishii | |
| 8,036,572 | B2 * | 10/2011 | Maeda | 399/119 |
| 2002/0012547 | A1 | 1/2002 | Mae | |
| 2007/0217818 | A1 | 9/2007 | Shiraki et al. | |
| 2007/0230998 | A1 * | 10/2007 | Ishii | 399/111 |
| 2007/0280730 | A1 * | 12/2007 | Okabe et al. | 399/111 |
| 2010/0028043 | A1 * | 2/2010 | Hashimoto et al. | 399/111 |

FOREIGN PATENT DOCUMENTS

| | | | |
|---|---|---|---|
| JP | 2002-062711 | A | 2/2002 |
| JP | 2002-267983 | A | 9/2002 |
| JP | 2003-295734 | A | 10/2003 |
| JP | 2006-221010 | A | 8/2006 |
| JP | 2007-256351 | | 10/2007 |
| JP | 2007-271763 | A | 10/2007 |
| JP | 2009-031821 | A | 2/2009 |

OTHER PUBLICATIONS

JP Decision of Patent Grant dated Mar. 6, 2012, in corresponding Application No. 2010-042968; English Translation.

* cited by examiner

*Primary Examiner* — David Gray
*Assistant Examiner* — Francis Gray
(74) *Attorney, Agent, or Firm* — Banner & Witcoff, Ltd.

(57) ABSTRACT

An image forming device includes a main casing, a support member, a plurality of developing cartridges, a handle provided to the support member, and a pair of interfering parts provided at both ends of the support member. Each developing cartridge includes a casing and a developing member supported by the casing. A gap between the pair of interfering parts is narrower than a length of the developing member, and the pair of interfering parts is located between the handle and one of the developing cartridges. Each of the interfering parts has a higher height than the handle.

4 Claims, 9 Drawing Sheets

IMAGE FORMING DEVICE INCLUDING PROCESS UNIT PROVIDED WITH HANDLE

CROSS REFERENCE TO RELATED APPLICATION

This application claims priority from Japanese Patent Application No. 2010-042968 filed Feb. 26, 2010. The entire content of this priority application is incorporated herein by reference.

TECHNICAL FIELD

The present invention relates to an image forming device, such as a laser printer.

BACKGROUND

There has been provided a tandem-type electrophotographic color printer that includes a plurality of photosensitive members corresponding to toner of yellow, magenta, cyan, and black and juxtaposed in a predetermined direction, and that also includes a plurality of developing cartridges for supplying toner to the corresponding photosensitive members.

In one type of such tandem-type color printers, developing cartridges are detachably mounted on a drum unit that can be pulled out frontward from a main casing. The drum unit is provided with a front handle at a front end thereof and a rear handle at a rear end thereof.

SUMMARY

With this configuration, when mounting a rearmost one of the developing cartridges onto the drum unit, if a user misjudges and holds the developing cartridge at a position rearward of a correct position with respect to the drum unit, then there is a danger that a developing roller of the developing cartridge contacts the rear handle. When the developing roller contacts the rear handle in this manner, toner held on the developing roller may cling to the rear handle, which may cause ink smear on a user's hand when the user touches the rear handle.

In view of the foregoing, it is an object of the invention to provide an image forming device capable of preventing a developing cartridge from contacting a handle of a developing unit.

In order to attain the above and other objects, the invention provides an image forming device including a main casing, a support member mounted in the main casing so as to be pulled out of the main casing in a first direction and supporting a plurality of photosensitive members aligned at intervals along the first direction, a plurality of developing cartridges in one-to-one correspondence with the plurality of photosensitive members, a handle provided to the support member on an upstream side of a most upstream side one of the developing cartridges in the first direction, and a pair of interfering parts provided at both ends of the support member with respect to a second direction. Each of the developing cartridges includes a casing and a developing member rotatably supported by the casing, and is detachably mounted on the support member. A gap between the pair of interfering parts in the second direction is narrower than a length of the developing member in the second direction. The pair of interfering parts is located between the handle and the most upstream side one of the developing cartridges in the first direction. Each of the interfering parts has a higher height than the handle in a third direction perpendicular to both the first direction and the second direction. The second direction is parallel to a rotational axis of the developing member.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
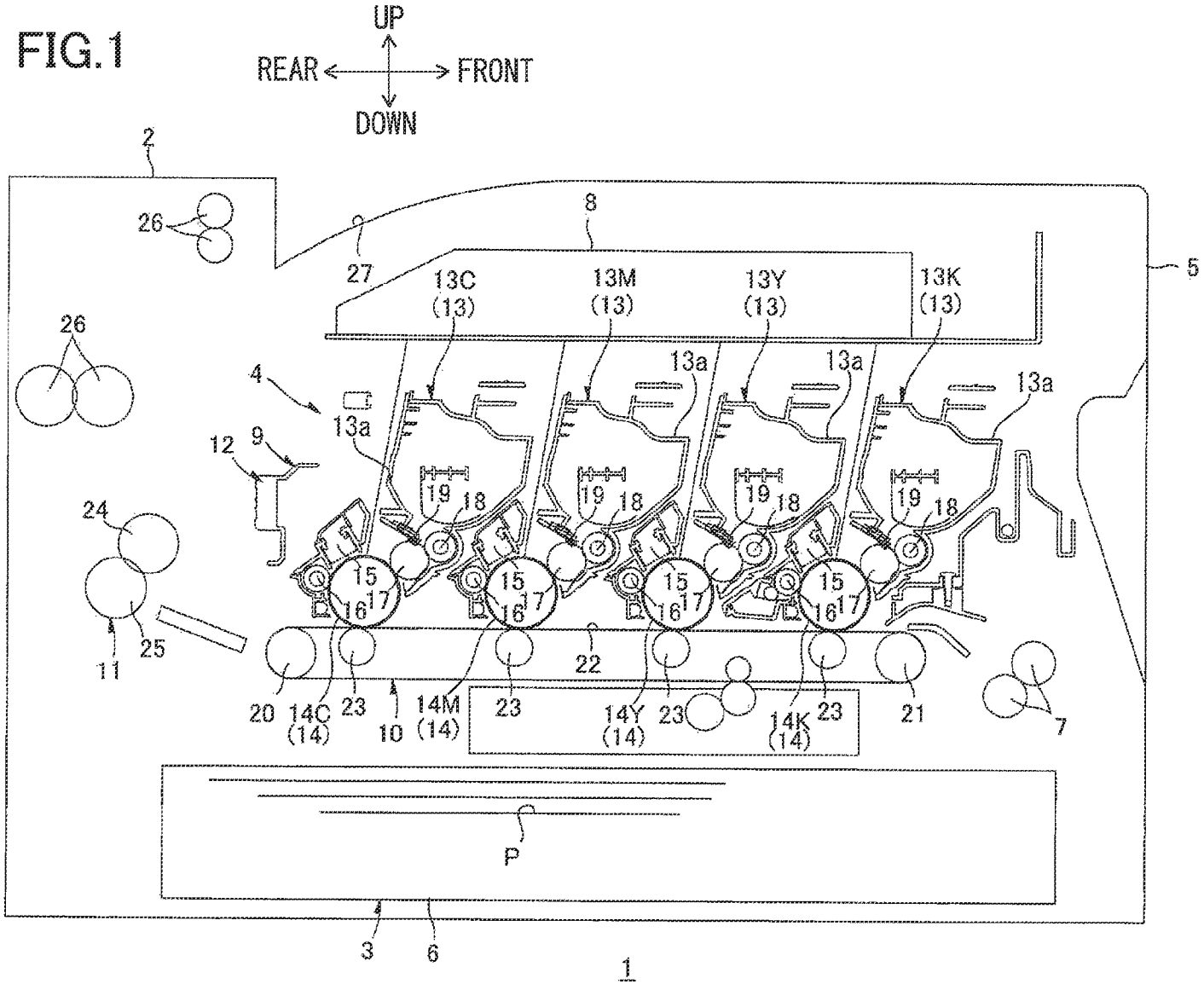
FIG. 1 is a cross-sectional left side view of a color laser printer as an image forming device according to an embodiment of the invention.

An image forming device according to an embodiment of the invention will be described while referring to the accompanying drawings wherein like parts and components are designated by the same reference numerals to avoid duplicating description. The present embodiment pertains to a color laser printer 1 shown in FIG. 1.

The terms "upward," "downward," "upper," "lower," "above," "below," "beneath," "right," "left," "front," "rear" and the like will be used throughout the description assuming that the color laser printer 1 is disposed in an orientation in which it is intended to be used. In use, the color laser printer 1 is disposed as shown in FIG. 1.

The color laser printer 1 of this embodiment is a direct-tandem type color laser printer. As shown in FIG. 1, the color laser printer 1 includes a main casing 2 and, within the main casing 2, a sheet supply unit 3 for supplying a sheet P and an image forming unit 4 for forming an image on the sheet P supplied from the sheet supply unit 3.

The main casing 2 is in a rectangular box shape in a side view, and is formed with a front cover 5 for selectively opening and closing a front opening formed in the main casing 2. The front cover 5 is pivotable about its lower end relative to the main casing 2.

The sheet supply unit 3 includes a sheet supply tray 6, which is disposed in the bottom of the main casing 2 for accommodating sheets P. The color laser printer 1 also includes a pair of registration rollers 7 disposed above a front end of the sheet supply tray 6.

The sheets P accommodated in the sheet supply tray 6 are supplied one at a time to a position between the registration rollers 7 and further to the image forming unit 4 (more precisely to a position between a photosensitive drum 14 to be described later and a transfer belt 22 to be described later) at a predetermined timing.

The image forming unit 4 includes a scanner unit 8, a process unit 9, a transfer unit 10, and a fixing unit 11.

The scanner unit 8 is disposed in the upper section of the main casing 2. Based on image data, the scanner unit 8 emits laser beams that irradiate four photosensitive drums 14 (described later) as indicated by solid lines in FIG. 1.

The process unit 9 is disposed below the scanner unit 8 and above the transfer unit 10, and includes a process frame 12 (support member) and four developing cartridges 13 (developing units) corresponding to each color. The process unit 9 can be freely detached from and attached to the main casing 2 by sliding in a front-rear direction.

The process frame 12 is disposed so as to be slidable in the front-rear direction with respect to the main casing 2, and supports the four photosensitive drums 14, four Scorotron chargers 15, and four drum cleaning rollers 16.

The photosensitive drums 14 are juxtaposed in the front-rear direction at fixed intervals such that each extends in a right-left direction. More specifically, the photosensitive drums 14 include a black photosensitive drum 14K, a yellow photosensitive drum 14Y, a magenta photosensitive drum 14M, and a cyan photosensitive drum 14C in the order from front to rear.

Each of the Scorotron chargers 15 is disposed at a position diagonally upward and rearward of the corresponding photosensitive drum 14 so as to confront the photosensitive drum 14 with a gap therebetween.

Each of the drum cleaning rollers 16 is disposed to contact the rear section of the corresponding photosensitive drum 14.

Each of the developing cartridges 13 is disposed above and in confrontation with the corresponding photosensitive drum 14, and is detachable from the process frame 12. More specifically, the developing cartridges 13 include a black developing cartridge 13K, a yellow developing cartridge 13Y, a magenta developing cartridge 13M, and a cyan developing cartridge 13C in the order from front to rear. Each developing cartridge 13 includes a casing 13*a* and a developing roller 17 (developing member) that is rotatable about a rotational axis extending in the right-left direction.

As will be described later, the developing roller 17 is rotatably supported at the bottom of the casing 13*a* such that a rear section of the developing roller 17 is exposed outside the casing 13*a* and contacts an upper front section of the photosensitive drum 14.

Each developing cartridge 13 also includes a supply roller 18 for supplying toner to the developing roller 17 and a thickness-regulation blade 19 for regulating a thickness of the toner supplied to the developing roller 17, and accommodates toner (developing agent) of each color in a space defined above the supply roller 18.

The toner accommodated in the developing cartridge 13 is supplied to the supply roller 18 and further to the developing roller 17, and tribocharged to a positive polarity at a position between the supply roller 18 and the developing roller 17.

The toner supplied to the developing roller 17 is formed into a layer of a thin thickness on the developing roller 17 by the thickness-regulation blade 19 as the developing roller 17 rotates.

The surface of the rotating photosensitive drum 14 is uniformly charged to a positive polarity by the Scorotron charger 15, and is irradiated with the high-speed scanning of the laser beam emitted from the scanner unit 8. As a result, an electrostatic latent image corresponding to an image to be formed on the sheet P is formed on the surface of the photosensitive drum 14.

When the photosensitive drum 14 further rotates, the toner that is supported on the surface of the developing roller 17 and that is charged to a positive polarity is selectively supplied to the electrostatic latent image formed on the surface of the photosensitive drum 14. As a result, the electrostatic latent image on the photosensitive drum 14 is transformed into a visible toner image by a reverse development.

The transfer unit 10 is disposed above the sheet supply unit 3 and below the process unit 9 in the main casing 2 along the front-rear direction. The transfer unit 10 includes a drive roller 20, a follow roller 21, the transfer belt 22, and four transfer rollers 23.

The drive roller 20 and the follow roller 21 are disposed in confrontation with each other with a gap therebetween in the front-rear direction.

The transfer belt 22 is wound around and extends between the drive roller 20 and the follow roller 21, and an upper section of the transfer belt 22 contacts the bottom section of each photosensitive drum 14. When the drive roller 20 is driven to rotate, the transfer belt 22 is driven to circulate in a counterclockwise direction in FIG. 1, such that the upper section of the transfer belt 22 moves rearward.

The transfer rollers 23 are disposed in the transfer belt 22 so as to confront the corresponding photosensitive drums 14 via the upper section of the transfer belt 22.

The sheet P supplied from the sheet supply unit 3 to the image forming unit 4 is conveyed rearward by the transfer belt 22 through transfer positions between the photosensitive drums 14 and the transfer belt 22 in sequence. The toner images of each color supported on the photosensitive drums 14 are transferred in sequence onto the sheet P being conveyed in this manner, thereby forming a color image on the sheet P.

Some toner may remain on the surface of the photosensitive drum 14 after the transfer of the toner image onto the sheet P. In this case, the reside toner on the photosensitive drum 14 is brought into confrontation with the drum cleaning roller 16 by the rotation of the photosensitive drum 14, and is transferred onto and held on the drum cleaning roller 16 by a cleaning bias applied to the drum cleaning roller 16.

The fixing unit 11 is disposed rearward of the transfer unit 10, and includes a heat roller 24 and a pressure roller 25 in confrontation with the heat roller 24. In the fixing unit 11, the color image transferred onto the sheet P is thermally fixed onto the sheet P when the sheet P passes through a position between the heat roller 24 and the pressure roller 25.

The sheet P with the color image fixed thereon is conveyed by discharge rollers 26 through a U-shaped path and discharged onto a discharge tray 27 formed above the scanner unit 8.

Figure 2:
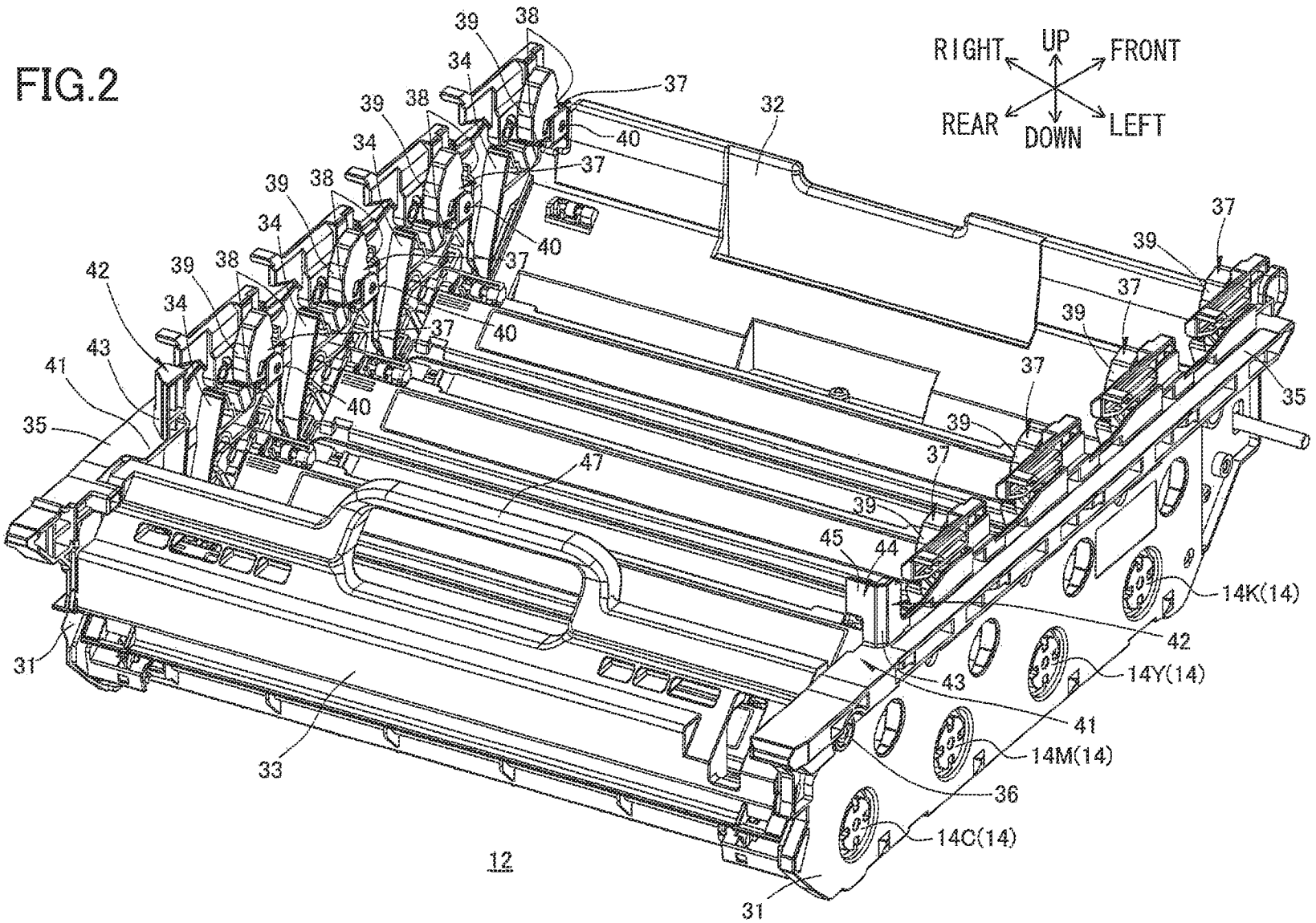
FIG. 2 is a perspective view of a process frame of the color laser printer of FIG. 1, from a point diagonally above and leftward thereof.

As shown in FIG. 2, the process frame 12 is formed in a rectangular shape having a long dimension aligned with the front-rear direction, and includes a pair of left and right side plates 31, a front beam 32, and a rear beam 33.

Figure 3:
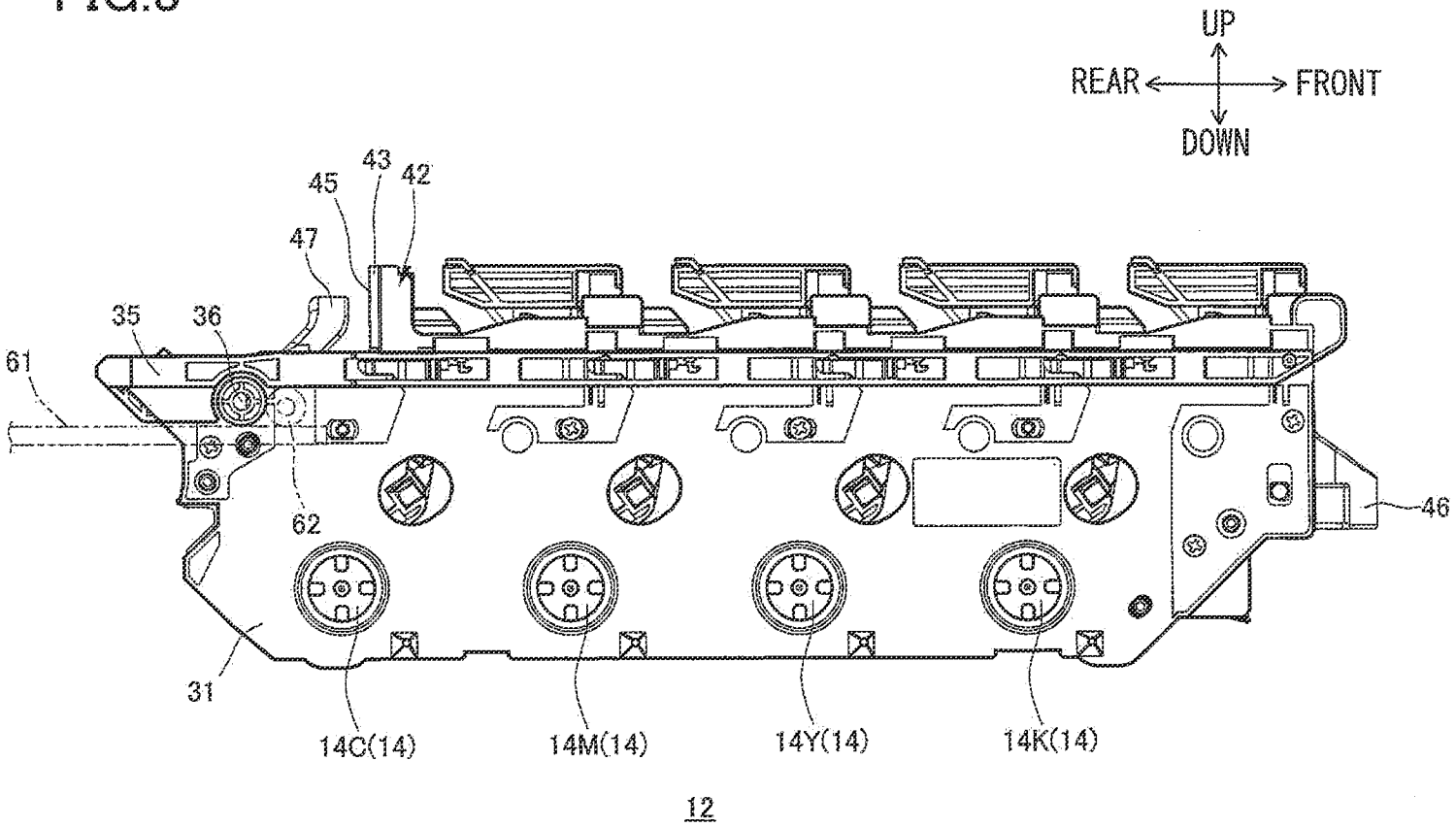
FIG. 3 is a left side view of the process frame.

The side plates 31 are in confrontation with each other with a gap therebetween. As shown in FIG. 3, each side plate 31 is formed in a rectangular shape with a long dimension aligned with the front-rear direction (only the left side plate 31 is shown in FIG. 3).

Figure 5:
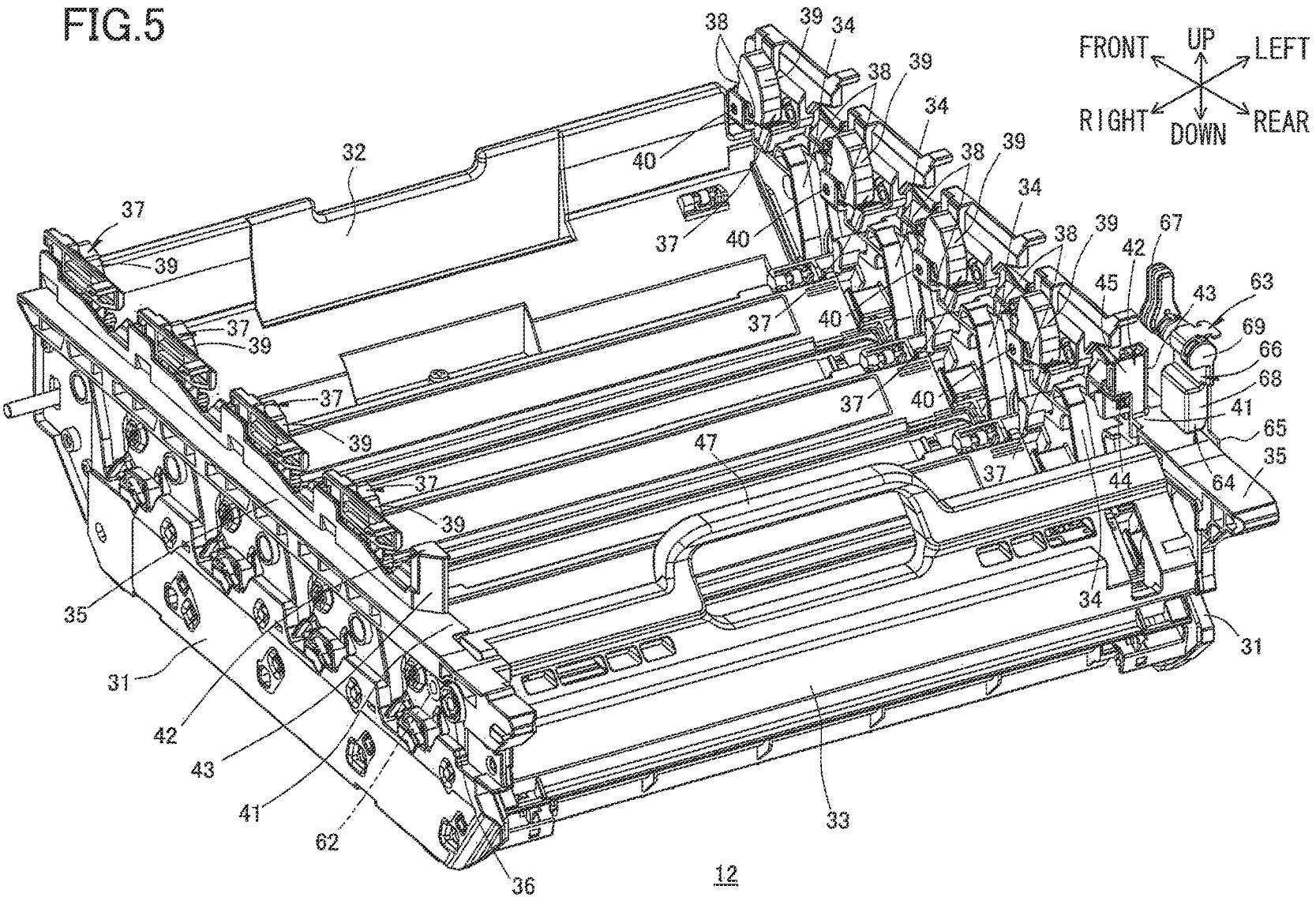
FIG. 5 is a perspective view of the process frame pulled out from a main casing.

As shown in FIGS. 2 and 5, each side plate 31 is formed with guide grooves 34, and includes a process-side guide rail 35 and a process-side collar 36.

The guide grooves 34 are formed on an inner side surface of the side plate 31 so as to be aligned at constant intervals in the front-rear direction and in confrontation with the upper front sections of the corresponding photosensitive drums 14. Each guide groove 34 is defined by a protrusion protruding inward from the inner surface of the side plate 31 into a shape of letter U with an open top, and extends from the upper section of the side plate 31 in a direction diagonally downward and rearward.

The process-side guide rail 35 protrudes outward from an outer surface of the side plate 31, and extends on the outer side of the upper ends of the guide grooves 34 along the entire length of the side plate 31 in the front-rear direction.

The process-side collar 36 is freely rotatably supported on the outer surface of the side plate 31 at a position beneath a rear section of the process-side guide rail 35.

Each side plate 31 is also provided with four pressing cams 37 at an upper section of the inner surface thereof. The pressing cams 37 are provided in one-to-one correspondence with the guide grooves 34.

Each pressing cam 37 is substantially in a fan shape in a side view. More specifically, the pressing cam 37 has a pair of flat parts 38 confronting with each other with a gap therebetween that grows wider toward the upper rear side, and also has a curved part 39 that connects between upper-rear ends of the flat parts 38 and that protrudes in the upper-rear direction in an arc shape.

The pressing cam 37 also has a rotary shaft 40 near the conjunction between lower-front ends of the flat parts 38. The rotary shaft 40 extends outward in the right-left direction, and is supported on the inner surface of the corresponding side plate 31. The pressing cam 37 is rotatable about the rotary shaft 40. Although not shown in the drawings, an urging member is provided for constantly urging the pressing cam 37 in a counterclockwise direction in a left side view.

Each side plate 31 also has an interfering-part support section 41 and an interfering part 42. In other words, the process frame 12 has the pair of left and right interfering parts 42.

The interfering-part support section 41 is formed in a flat-plate shape that protrudes inward from the upper section of the side plate 31 at a position between the rear beam 33 and a rearmost one of the guide grooves 34 (the cyan developing cartridge 13C). The interfering-part support section 41 extends along the entire width of the guide groove 34 in the right-left direction.

The interfering part 42 is formed substantially in a rectangular column shape, and extends upward from an inner edge of an upper surface of the interfering-part support section 41. The interfering parts 42 of the right and left side plates 31 are disposed in confrontation with each other with a gap therebetween in the right-left direction, and the gap between the interfering parts 42 is set narrower than a length of a developing roller shaft 55 (FIG. 4, described later) of the developing roller 17 in the right-left direction. The interfering part 42 has a higher height than a rear handle 47 (FIG. 6, described later) with respect to an up-down direction.

A rear outer corner of the interfering part 42 has been chamfered to form a guide surface 43 that extends diagonally outward and frontward.

One of the interfering parts 42 on the left side (hereinafter referred to as the "left interfering part 42") is formed with a protrusion 44 in substantially a rectangular plate shape in a front view. The protrusion 44 extends rightward from a rear edge of a right surface of the interfering part 42, and has a rear surface serving as an interfering surface 45. The interfering surface 45 is formed substantially flash with a rear endface of the interfering part 42 on the right side.

The front beam 32 is formed in a rectangular flat plate shape having a long dimension in the right-left direction in a front view, and spans between front edges of the side plates 31. The front beam 32 is formed with a front handle 46 shown in FIG. 3, which a user holds when inserting or detaching the process unit 9 to or from the main casing 2.

The front handle 46 is disposed substantially at the center of the front beam 32 in the right-left direction so as to protrude frontward from a front surface of the front beam 32.

As shown in FIG. 2, the rear beam 33 is formed substantially in a rectangular flat plate shape having a long dimension in the right-left direction in a front view, and spans between rear edges of the side plates 31. The rear beam 33 is formed with the rear handle 47, which a user holds when inserting or detaching the process unit 9 to or from the main casing 2.

The rear handle 47 is disposed substantially at the center of the rear beam 33 in the right-left direction. The rear handle 47 is formed substantially in a shape of reversed letter U with an open bottom, and protrudes upward from an upper surface of the rear beam 33. The rear handle 47 is located rearward of the cyan developing cartridge 13C mounted in the process frame 12.

Figure 4:
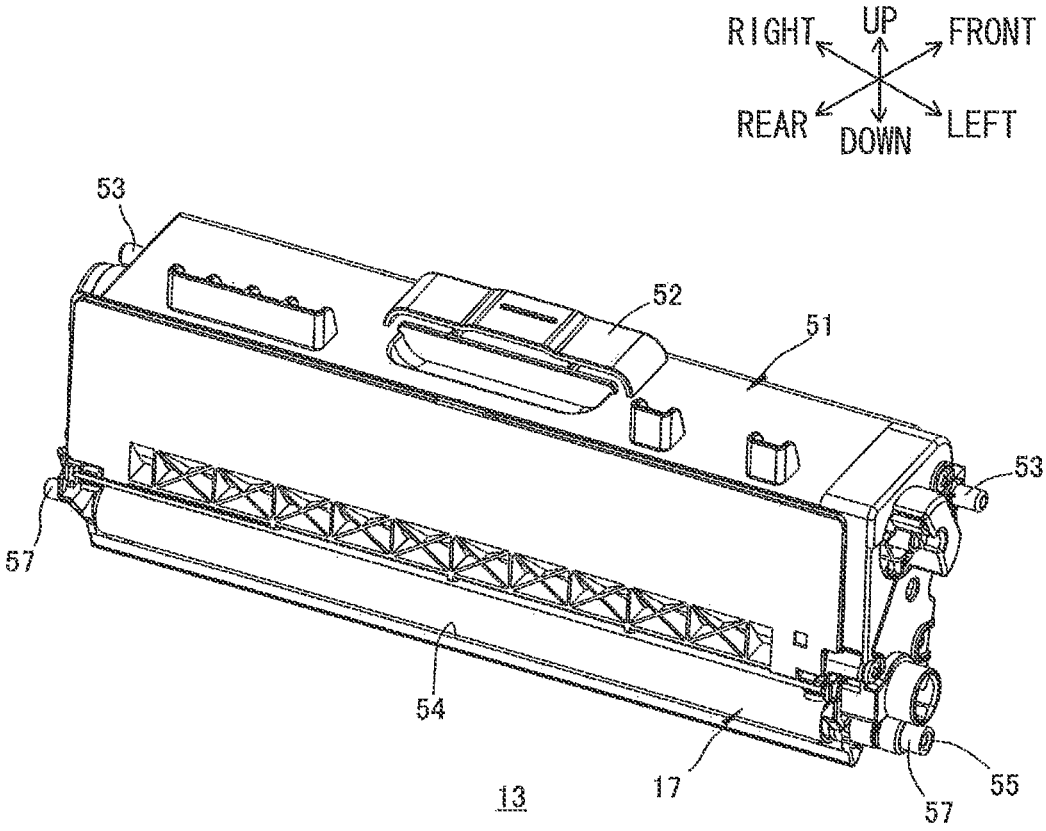
FIG. 4 is a perspective view of a developing cartridge according to the embodiment of the invention, from a point diagonally above and rearward thereof.

As shown in FIG. 4, each of the developing cartridges 13 includes a frame 51 and the developing roller 17 described above.

The frame 51 is formed substantially in an isosceles-triangle-prism box shape having vertex angles at a lower rear side and extending in the right-left direction. That is, each of right and left side surfaces of the frame 51 is substantially in an isosceles triangle shape with a vertex angle at the lower rear side.

The frame 51 has a developing handle 52 on its upper surface and a pair of right and left bosses 53 at its upper front section, and is formed with an opening 54 at its lower rear section.

The developing handle 52 is disposed at the center of the frame 51 in the right-left direction and extends in the right-left direction. The developing handle 52 is formed substantially in a shape of inverted letter U with an open bottom, and protrudes upward from the upper surface of the frame 51.

The bosses 53 are formed substantially in a cylindrical shape and protrude outward from the right and left side surfaces of the frame 51. The opening 54 is formed along the entire length of the frame 51 in the right-left direction, and is opened to the rear side.

The developing roller 17 extends in the right-left direction, and is disposed in the lower section of the frame 51 such that a rear part of the developing roller 17 is exposed outside the frame 51 from the opening 54. The developing roller 17 has the developing roller shaft 55. The developing roller shaft 55 is formed to have a length in the right-left direction such that right and left ends of the developing roller shaft 55 can fit in the corresponding guide grooves 34 of the side plates 31, and collar members 57 are fitted over right and left ends of the developing roller shaft 55.

The developing roller 17 is freely rotatably supported to the frame 51 via the developing roller shaft 55 whose right and left sections are freely rotatably supported at the right and left ends of the frame 51.

The main casing 2 includes a pair of main-body-side guide rails 61 and a pair of main-body side collars 62 indicated by a dotted chain line in FIG. 3 (only one of each is shown in FIG. 3). Note that the positions of the main-body-side guide rail 61 and the main-body side collar 62 indicated by the dotted chain line in FIG. 3 are those of when the process frame 12 is located at a drawn position to be described later.

The main-body-side guide rails 61 are disposed in correspondence with the process-side guide rails 35, extend in the front-rear direction, and protrude inward from inner side surfaces of the main casing 2. When the process unit 9 is mounted in the main casing 2, the main-body-side guide rails 61 support the process-side collars 36 from the bottom.

The main-body side collars 62 are disposed above the front sections of the main-body-side guide rails 61 and freely rotatably supported at the inner side surfaces of the main casing 2. When the process unit 9 is mounted in the main casing 2, the main-body side collars 62 contact the bottom sides of the process-side guide rails 35.

The main casing 2 also includes a lock mechanism 63 shown in FIG. 5. The lock mechanism 63 is fixed on the inner surface of a left wall of the main casing 2, and includes a lock member 64 (regulation member) and a support member 65.

The lock member 64 integrally includes a regulation part 66 and an operation part 67. The regulation part 66 is formed substantially in a rod shape, and integrally includes a lower part, which is an abutting part 68 substantially in a rectangular column shape, and an upper part, which is a shaft part 69 substantially in a cylindrical shape extending in the front-rear direction.

The operation part 67 is disposed at the front end of the shaft part 69 so as to extend in a direction away from the abutting part 68. The operation part 67 is formed substantially in a rectangular column shape.

The support member 65 is fixed in the inner surface of the left wall of the main casing 2. An upper section of the support member 65 is formed substantially in a cylindrical shape extending in the front-rear direction, and is fitted over the shaft part 69 of the regulation part 66, such that the lock member 64 is rotatable relative to the support member 65.

The lock member 64 is usually located at a regulation position so as to extend in the up-down direction as shown in FIG. 5. When the lock member 64 is at the regulation position, the abutting part 68 is located at a lower position leftward of the interfering part 42, and the operation part 67 protrudes upward. Also, the abutting part 68 is located above and confronts the upper surface of one of the process-side guide rails 35 on the left side (hereinafter referred to as the "left process-side guide rail 35"). With this configuration, the abutting part 68 prevents upward movement of the left process-side guide rail 35 and thus upward movement of the process frame 12.

Figure 8:
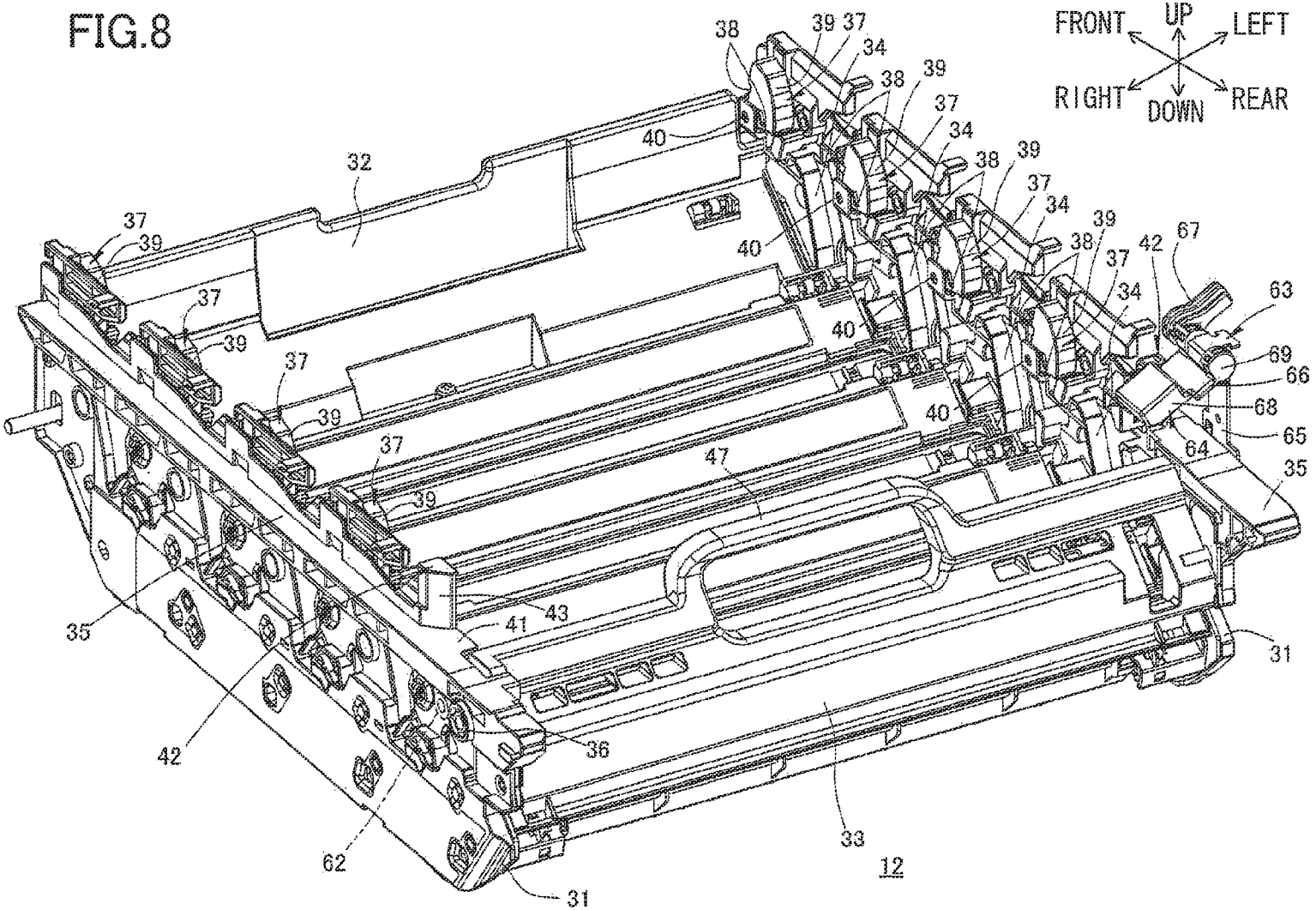
FIG. 8 is a perspective view of the process frame pulled out from the main casing, with a lock member at a regulation position.
Figure 9:
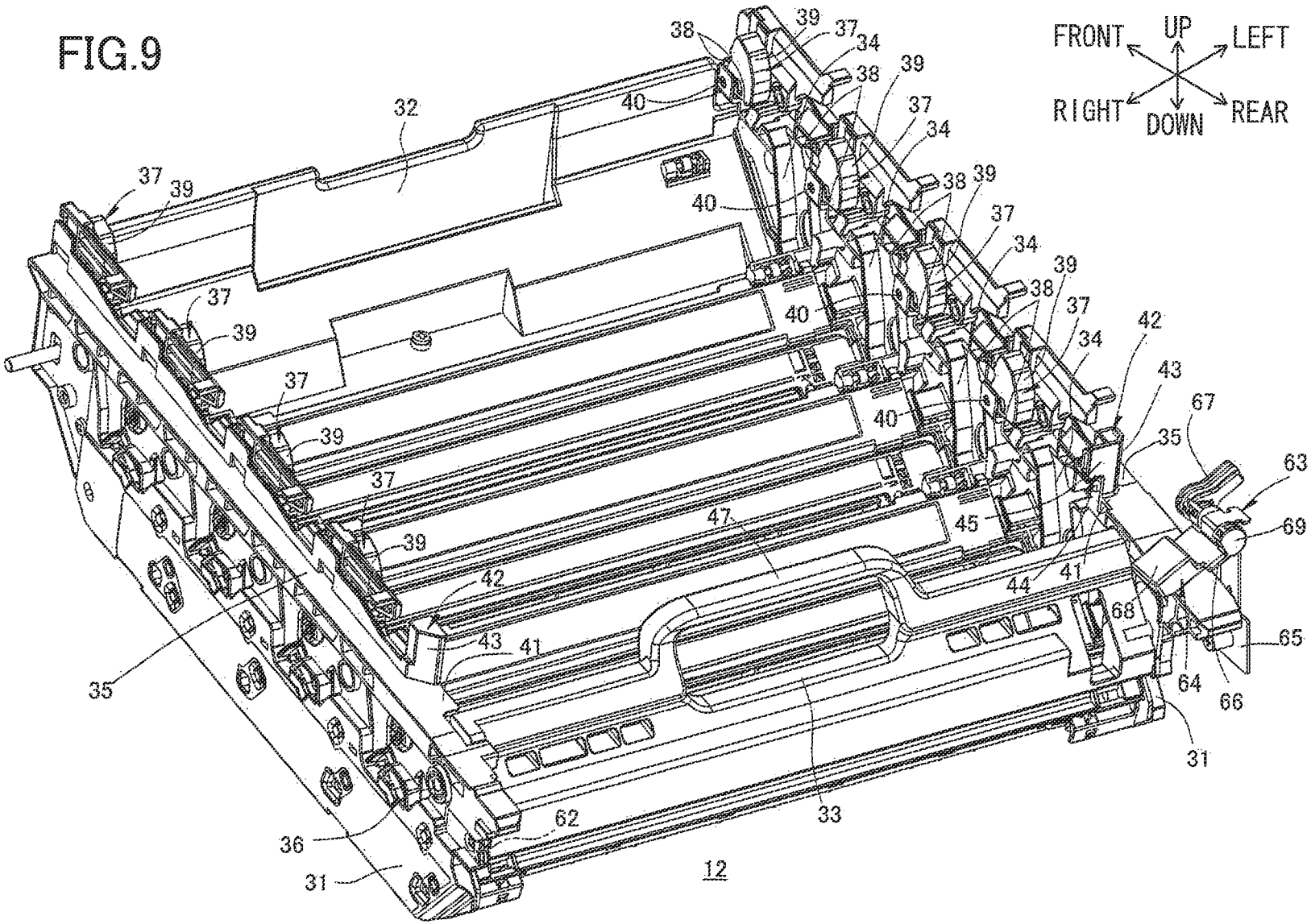
FIG. 9 is a perspective view of the process frame with its front end uplifted.

When the operation part 67 is tilted leftward as shown in FIG. 8, then the regulation part 66 is moved diagonally upward and rightward to a releasing position, and allows the left process-side guide rail 35 to move upward.

Next, attachment and detachment of the developing cartridges 13 will be described.

In order to attach the developing cartridges 13 into the main casing 2, the developing cartridges 13 are first mounted onto the process frame 12 of the process unit 9. Note that the process frame 12 is initially in an accommodated position (first position) in the main casing 2, and that the lock member 64 of the lock mechanism 63 is initially located at the regulation position as shown in FIG. 5.

In order to mount the developing cartridges 13 onto the process frame 12, a user tilts the front cover 5 frontward to expose the front opening of the main casing 2, grabs the front handle 46 of the process frame 12, and then pulls the process frame 12 frontward from the accommodated position in the main casing 2.

When the user pulls the process frame 12 in this manner, the process-side guide rails 35 slide on the main-body side collars 62 (FIG. 3), and the process-side collars 36 rotate along the upper surfaces of the main-body-side guide rails 61.

After the left interfering part 42 is moved past the right side of the lock mechanism 63, the process-side collars 36 abut the rear sections of the main-body side collars 62 as shown in FIG. 3, thereby preventing the user from pulling the process frame 12 further frontward. This completes drawing of the process frame 12 from the main casing 2.

When the drawing of the process frame 12 completes, the process frame 12 is located at the drawn position (second position) mentioned above. Also, as described above, the lock member 64 (FIG. 5) prevents the upward movement of the process frame 12. Thus, the process frame 12 is prevented from moving frontward from the drawn position to a detaching position to be described later.

Then, each of the developing cartridges 13 is mounted on the process frame 12. More specifically, first a user grabs the developing handle 52 (FIG. 4) of the developing cartridge 13, and holds the developing cartridge 13 at a position above the process frame 12 and along the corresponding photosensitive drum 14 in the right-left direction. Then, the user lowers and inserts the developing cartridge 13 into the process frame 12.

As the developing cartridge 13 is inserted into the process frame 12, the left end of the developing roller shaft 55 (FIG. 4) is fitted into the guide groove 34 of the left side plate 31 from above, and the right end of the developing roller shaft 55 is fitted into the guide groove 34 of the right side plate 31 from above.

As a result, the developing cartridge 13 is inserted into the process frame 12 while the right and left ends of the developing roller shaft 55 are guided by the guide grooves 34.

When the developing roller 17 contacts the upper section of the photosensitive drum 14, further insertion of the developing cartridge 13 is prevented, and the developing roller 17 is positioned with respect to the photosensitive drum 14.

At this time, the bosses 53 (FIG. 4) are in contact with the lower rear sections of the curved parts 39 of the pressing cams 37 (FIG. 5).

Next, while grabbing the developing handle 52 (FIG. 4), the user turns the developing cartridge 13 frontward. As a result, the developing cartridge 13 pivots frontward about the developing roller shaft 55 (FIG. 4), and the bosses 53 press the pressing cams 37 frontward to rotate the pressing cams 37 (FIG. 5) in the counterclockwise direction in the left side view and then move to positions beneath the pressing cams 37. When the bosses 53 move to the positions beneath the pressing cams 37, the pressing cams 37 engage with the bosses 53 from above, and press the bosses 53 diagonally downward and rearward by the urging force of the urging member (not shown).

With this configuration, the developing cartridge 13 is pressed diagonally downward and rearward by the pressing cams 37 against the upper front section of the corresponding photosensitive drum 14.

Figure 6:
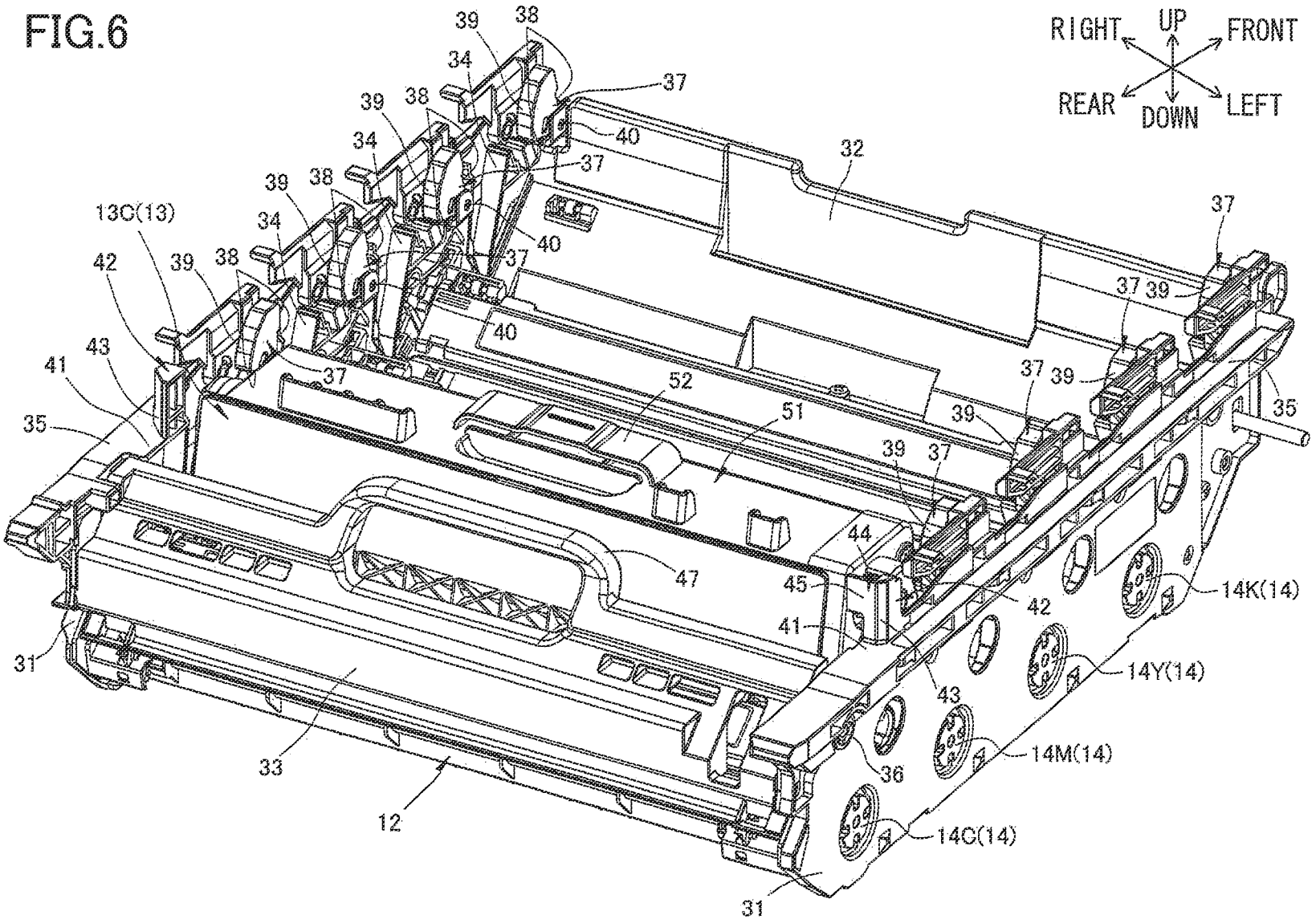
FIG. 6 is a perspective view of the process frame accommodated in the main casing.

Then, the mounting of the developing cartridge 13 onto the process frame 12 completes, as shown in FIG. 6. The rest of the developing cartridges 13 are mounted on the process frame 12 in the same manner.

Here, a user may misjudge and hold the cyan developing cartridge 13C, which is the innermost (rearmost) one among the four developing cartridges 13, at a wrong position, such as a position diagonally upward and rearward of the corresponding guide grooves 34, and then try to lower the cyan developing cartridge 13C into the process frame 12.

Figure 7:
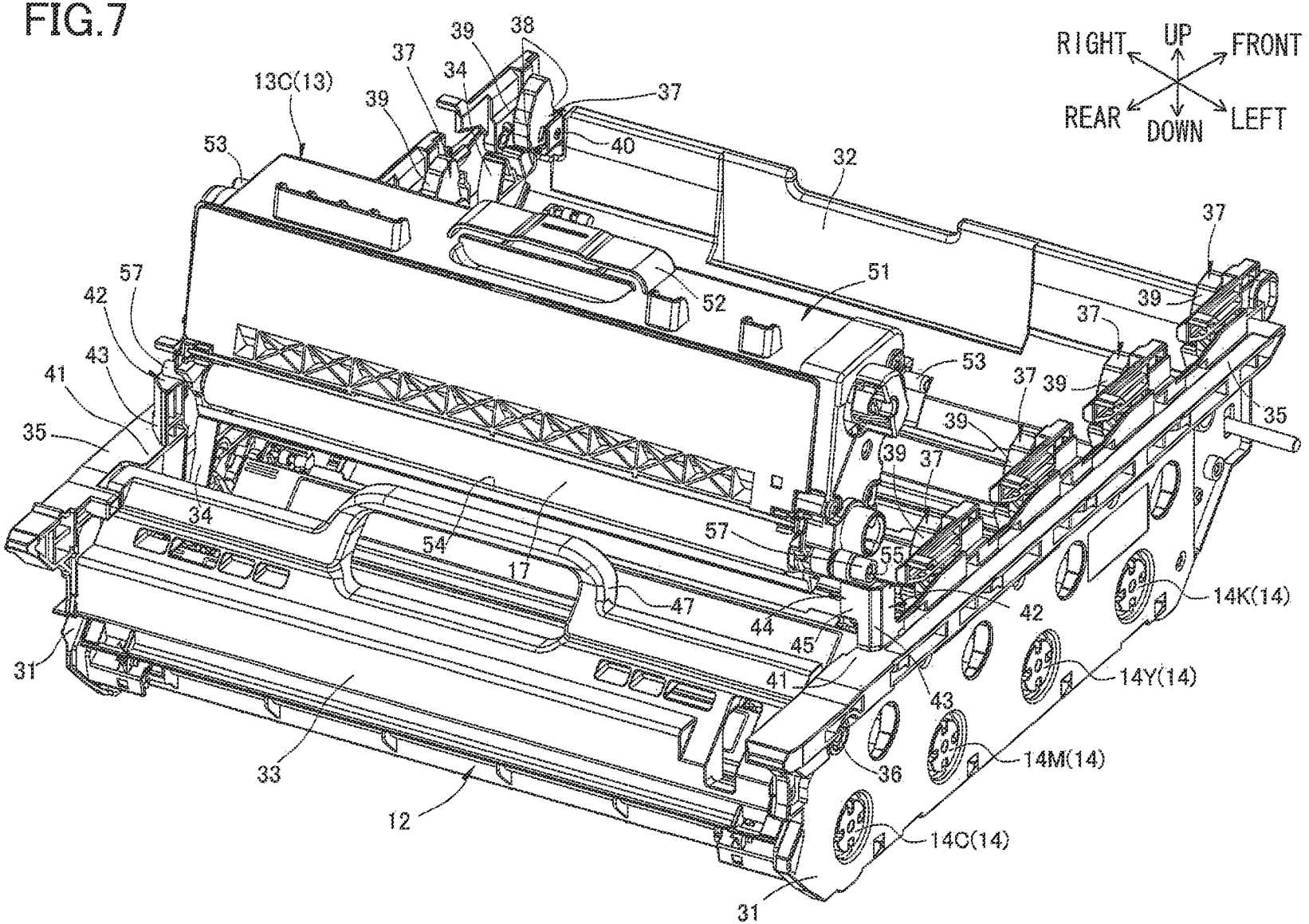
FIG. 7 is a perspective view of the process frame with a developing cartridge interfered with interfering parts of the process frame.

In this case, as shown in FIG. 7, the collar members 57 mounted on the right and left ends of the developing roller shaft 55 of the cyan developing cartridge 13C abuts the upper parts of the interfering parts 42. This prevents the developing cartridge 13C from contacting the rear handle 47. This also prevents insertion of the cyan developing cartridge 13C into the process frame 12.

If the cyan developing cartridge 13C abuts the interfering parts 42 as described above, then the user can reposition the cyan developing cartridge 13C and mount the cyan developing cartridge 13C onto the process frame 12 in the above-described manner.

Note that the user can detach the developing cartridge 13 from the process frame 12 according to the reverse procedure to mounting the developing cartridge 13. That is, grabbing the developing handle 52, the user rotates the developing cartridge 13 rearward, and then pulls the developing cartridge 13 upward to detach the same from the process frame 12.

After mounting the four developing cartridges 13 onto the process frame 12 of the process unit 9 in the above-described manner, the user mounts the process unit 9 into the main casing 2 in the following manner.

First, the user presses the process unit 9 (the process frame 12) rearward into the main casing 2. At this time, the process unit 9 is guided by the main-body-side guide rails 61 in the front-rear direction and by the guide surfaces 43 of the interfering parts 42 in the right-left direction.

When the process unit 9 is completely inserted into the main casing 2 as shown in FIG. 1, the photosensitive drums 14 contact the upper surface of the transfer belt 22.

Then, the user pivots the front cover 5 rearward to close the front opening of the main casing 2. This completes the mounting of the process unit 9 into the main casing 2.

The user can detach the process unit 9 from the main casing 2 by pulling the process unit 9 frontward after tilting the front cover 5 frontward.

For example, if paper jam occurs at the image forming unit 4 during image forming operations, then the user can remove the jammed paper by detaching the process unit 9 from the main casing 2.

Specifically, the user pulls the process unit 9 (the process frame 12) from the main casing 2 to the drawn position. At this time, the lock member 64 of the lock mechanism 63 is at the regulation position as shown in FIG. 5. Thus, the user cannot pull the process unit 9 further frontward to the detaching position in this condition, and thus cannot completely detach the process unit 9 from the process frame 12.

Then, the user operates the operation part 67 of the lock mechanism 63 to rotate the same leftward so as to bring the lock member 64 to the releasing position as shown in FIG. 8. As a result, the upward movement of the process-side guide rails 35 is allowed. This enables the front section of the process frame 12 (the process unit 9) to move upward.

Thus, when the user grabs and lifts up the front handle 46, then the process unit 9 is pivoted upward about its rear end, and the process-side collars 36 are lifted up to positions upward of the main-body side collars 62, thereby releasing the abutment between the process-side collars 36 and the main-body side collars 62 in the front-rear direction.

Then, the user pulls the process unit 9 frontward slightly, while maintaining the pivoted posture of the process unit 9. At this time, the main-body side collars 62 move beneath the process-side collars 36, so the process unit 9 can be pulled outside the main casing 2 to the detaching position (third position).

While grabbing the front handle 46, the user grabs the rear handle 47 with the other hand, and detaches the process unit 9 from the main casing 2. This completes detachment of the process unit 9 from the main casing 2.

Then, the user removes the jammed paper from the image forming unit 4, and attaches the process unit 9 to the main casing 2 according to the reversed procedure to detaching of the process unit 9 from the main casing 2.

Note that when the lock member 64 is at the releasing position as shown in FIG. 8, the regulation part 66 has been pivoted rightward. Thus, the abutting part 68 protrudes to a position on the rear side of the left interfering part 42, and the rear surface of the abutting part 68 is in confrontation with the interfering surface 45 (FIG. 5) of the left interfering part 42 from the rear side.

Therefore, the rearward movement of the process unit 9 (from the drawn position to the accommodated position) is prevented when the lock member 64 is at the releasing position, because the abutting part 68 of the lock member 64 abuts the interfering part 42.

As described above, according to this embodiment, the process frame 12 is provided with the pair of interfering parts 42 between the rear handle 47 and the cyan developing cartridge 13C, and each interfering part 42 has the higher height than the rear handle 47. Also, the gap between the interfering parts 42 in the right-left direction is narrower than the length of the developing roller 17 in the right-left direction.

Thus, even if the user misjudges and holds the cyan developing cartridge 13C at a position rearward of a correct position when mounting the cyan developing cartridge 13C into the process frame 12, the right and left ends of the cyan developing cartridge 13C come into abutment with the interfering parts 42, thereby preventing the cyan developing cartridge 13C from contacting the rear handle 47. Thus, it is possible to prevent the toner from clinging onto the rear handle 47.

Also, according to this embodiment, when the lock member 64 is placed at the releasing position as shown in FIG. 8 while the process frame 12 (the process unit 9) is at the drawn position, then the lock member 64 prevents mounting of the process unit 9 to the main casing 2 (i.e., movement of the process unit 9 from the drawn position to the accommodated position) by abutting the left interfering part 42 from the rear side.

Thus, it is possible to regulate the movement of the process frame 12 in the front-rear direction by using the left interfering part 42, without providing an additional member to interfere with the lock member 64. This reduces the number of components.

Note that regulating the movement of the process frame 12 in the front-rear direction makes it possible to position the rear part of the process frame 12 with respect to the main casing 2 and to make the process frame 12 (the process unit 9) easily pivot about the rear part thereof.

Also, according to the present embodiment, the interfering surface 45 of the left interfering part 42 reliably interferes with the lock member 64.

Further, the guide surfaces 43 guide the process frame 12 into the main casing 2 to facilitate mounting of the process frame 12 into the main casing 2.

While the invention has been described in detail with reference to the embodiment thereof, it would be apparent to those skilled in the art that various changes and modifications may be made therein without departing from the spirit of the invention.

What is claimed is:

1. An image forming device comprising:

a main casing;

a support member mounted in the main casing so as to be pulled out of the main casing in a first direction, the support member supporting a plurality of photosensitive members aligned at intervals along the first direction;

a plurality of developing cartridges in one-to-one correspondence with the plurality of photosensitive members, wherein each of the developing cartridges includes a casing and a developing member rotatably supported by the casing, and each is detachably mounted on the support member;

a handle provided to the support member on an upstream side of a most upstream side one of the developing cartridges in the first direction; and a pair of interfering parts provided at both ends of the support member with respect to a second direction parallel to a rotational axis of the developing member, wherein:

a gap between the pair of interfering parts in the second direction is narrower than a length of the developing member in the second direction;

the pair of interfering parts is located between the handle and the most upstream side one of the developing cartridges in the first direction; and each of the interfering parts has a higher height than the handle in a third direction perpendicular to both the first direction and the second direction.

2. The image forming device according to claim 1, wherein:

the support member is capable of moving selectively to a first position within the main casing, a second position on a downstream side of the first position in the first direction, and a third position out of the main casing;

the main casing includes a regulation member that is movable between a regulating position and a releasing position, the regulation member at the regulating position preventing movement of the support member from the second position to the third position, the regulation member at the releasing position allowing the movement of the support member from the second position to the third position;

the regulation member at the releasing position prevents movement of the support member from the second position to the first position by interfering with one of the interfering parts.

3. The image forming device according to claim 2, wherein the one of the interfering parts has an interfering surface that interferes with the regulation member.

4. The image forming device according to claim 1, wherein each of the interfering parts has a guide surface that guides the support member into the main casing.

* * * * *